US011407003B2

(12) United States Patent
Chen et al.

(10) Patent No.: US 11,407,003 B2
(45) Date of Patent: Aug. 9, 2022

(54) PNEUMATIC GLUE GUN

(71) Applicant: Jiangnan University, Wuxi (CN)

(72) Inventors: Xiang Chen, Wuxi (CN); Qingwen Guo, Wuxi (CN); Zhiwei Chen, Wuxi (CN); Yuexin Huang, Wuxi (CN)

(73) Assignee: Jiangnan University, Wuxi (CN)

( * ) Notice: Subject to any disclaimer, the term of this patent is extended or adjusted under 35 U.S.C. 154(b) by 68 days.

(21) Appl. No.: 16/997,936

(22) Filed: Aug. 20, 2020

(65) Prior Publication Data

US 2021/0283647 A1 Sep. 16, 2021

(30) Foreign Application Priority Data

Mar. 13, 2020 (CN) ..... 202010173266.1

(51) Int. Cl.
*B05C 17/015* (2006.01)
*B05C 17/005* (2006.01)

(52) U.S. Cl.
CPC ..... *B05C 17/015* (2013.01); *B05C 17/00576* (2013.01)

(58) Field of Classification Search
CPC ..... B05C 17/015; B05C 17/0116; B05C 17/00576
USPC ..... 222/386, 386.5, 389, 399
See application file for complete search history.

(56) References Cited

U.S. PATENT DOCUMENTS 2,692,706 A * 10/1954 Wiksten ..... B05C 17/015 222/326
2,976,897 A * 3/1961 Beckworth ..... B05B 9/0833 222/399
3,501,063 A * 3/1970 Sundholm ..... F16N 3/12 222/326
3,712,516 A * 1/1973 Stamets ..... B05C 17/015 222/326
3,980,209 A * 9/1976 Collar ..... B05C 17/015 222/323

(Continued)

FOREIGN PATENT DOCUMENTS

GB 660031 A * 10/1951 ..... F16N 5/02

OTHER PUBLICATIONS

Hose Definition & Meaning—Merriam-Webster, obtained on Dec. 16, 2021 from: https://www.merriam-webster.com/dictionary/hose.*

*Primary Examiner* — Paul R Durand
*Assistant Examiner* — Randall A Gruby
(74) *Attorney, Agent, or Firm* — Idea Intellectual Limited; Margaret A. Burke; Sam T. Yip

(57) ABSTRACT

The present invention relates to a pneumatic glue gun including tank components which contain a glue hose and an injector head; pressure generating units which contain a shell, an extruder, a slidable piston and a push/pull rod; and a drive component connected with the extruder. The tank components are fixed on the shell through a open end of the glue hose and faced the interior space of the shell. The drive component increases the atmospheric pressure between the extruder and the piston by driving the movement of the extruder in the shell, and the piston slides in the glue hose through the increased atmospheric pressure. The glue of the present invention does not need to be replaced, and the glue can be replenished at any time, so the work of replacing the tank is eliminated, and no waste of resources is caused.

11 Claims, 5 Drawing Sheets

(56) References Cited

U.S. PATENT DOCUMENTS 4,162,030 A * 7/1979 Capra ..... B67D 1/0462 239/323
4,171,072 A * 10/1979 Davis, Jr. ..... B05C 17/0103 222/326
4,197,884 A * 4/1980 Maran ..... B65D 83/42 141/113
4,376,498 A * 3/1983 Davis, Jr. ..... B05C 17/015 222/326
4,426,024 A * 1/1984 Hogan ..... A61M 5/204 222/173
5,060,826 A * 10/1991 Coleman ..... B67D 1/0462 222/105
5,150,820 A * 9/1992 McGill ..... A23G 9/283 222/326
5,179,982 A * 1/1993 Berube ..... B65B 31/003 222/105
5,181,636 A * 1/1993 Anderson ..... B05C 17/015 222/389
7,334,709 B1 * 2/2008 Huang ..... B05C 17/015 222/334
7,913,881 B2 * 3/2011 Herman ..... F16J 1/06 92/204
10,258,399 B2 * 4/2019 Vogt ..... B05C 17/00559
10,543,507 B2 * 1/2020 Roth ..... B05C 17/01
2006/0043120 A1 * 3/2006 Campbell ..... G01F 11/026 222/386.5
2008/0144426 A1 * 6/2008 Janssen ..... B01F 35/522 366/162.3
2015/0053717 A1 * 2/2015 Williams ..... B05B 11/02 222/326
2015/0069091 A1 * 3/2015 Mizoguchi ..... B05C 17/015 222/389
2020/0338578 A1 * 10/2020 Hanson ..... B05B 7/1272
2020/0406290 A1 * 12/2020 Frey, Sr. ..... B32B 27/40
2021/0346909 A1 * 11/2021 Kuchinski ..... B65D 83/0033

* cited by examiner

PNEUMATIC GLUE GUN

CROSS-REFERENCE TO RELATED APPLICATIONS

This application claims priority to Chinese patent application No. 2020101732661 filed on Mar. 13, 2020, and the disclosure of which is incorporated herein by reference in its entirety.

FIELD OF THE INVENTION

The invention relates to the technical field of construction and manufacturing, in particular to a pneumatic glue gun.

BACKGROUND

A pneumatic glue gun is a tool for glue spraying or glue extrusion, and it may be used wherever the glue is necessary. The pneumatic glue guns are widely used in some industries such as construction and decoration, electronic appliances, automobiles and auto parts, shipping and containers, etc. At present, the capacity of the glue gun for glue storage is limited. When the glue in the tank runs out, it is necessary to disassemble and discard the old tank, and replace with a new one, thereby leading to a large number of empty tanks which are shelved and wasted. In this way, it is not sustainable, and the replacement of the tanks is very complicated.

SUMMARY OF THE INVENTION

The present invention has the following advantages: The glue tank of the present invention adopts a detachable connection. When the glue in the tank runs out, the tank can be disassembled and filled with supplement glue, then the tank is finally reassembled to the glue gun to achieve the purpose of recycling, hence its sustainability is good. In addition, since the glue can be replenished at any time without replacing the tank, the work of replacing the tank is eliminated, and no resources are wasted.

In a first aspect, the present invention provides a pneumatic glue gun which includes tank components (100) including a glue hose (101) and an injector head (102) installed at a first end of the glue hose (101), where a storage space (R) is inside the glue hose (101); pressure generating units (200) which include a shell (201); an extruder (202) installed inside the shell (201); a slidable piston (203) installed inside the glue hose (101); and a push/pull rod (204) fixed on the piston (203) and protruding out of the shell (201), where the tank components (100) are fixed on the shell (201) through an open end of the glue hose (101) and faced the interior space of the shell (201); and a drive component (300) connected with the extruder (202), where the drive component increases the atmospheric pressure between the extruder (202) and the piston (203) by driving the movement of the extruder (202) in the shell (201), and the piston (203) slides in the glue hose (101) through the increased atmospheric pressure.

In a first embodiment of the first aspect of the present invention, the shell (201) includes a first pressure chamber (201*a*); a second pressure chamber (201*b*); and a connection end (201*c*). The first and second pressure chambers (201*a*, 201*b*) and the connection end (201*c*) are connected in sequence. The drive component (300) is fixed on the first pressure chamber (201*a*). The outer wall of the connection end (201*c*) is provided with an external thread (L-1), the inner wall of the open end of the glue hose (101) is provided with an internal thread (L-2) matching the external thread (L-1), and the open end of the glue hose (101) is fixed on the connection end (201*c*) through the matching threads.

In a second embodiment of the first aspect of the present invention, there is a clapboard (201*d*) installed between the first pressure chamber (201*a*) and the second pressure chamber (201*b*), and the clapboard (201*d*) is provided with one or more first unidirectional holes (201*d*-1). There is a finite ring (201*e*) installed between the second pressure chamber (201*b*) and the connection end (201*c*), and the inner diameter of the finite ring (201*e*) is smaller than that of the second pressure chamber (201*b*). The extruder (202) includes a pressure plate (202*a*), one or more spheres (202*b*), a first elastic piece (202*c*), a second elastic piece (202*d*), an extruded column (202*e*), and a third elastic piece (202*f*), where the pressure plate (202*a*), the spheres (202*b*), the first elastic piece (202*c*) and the second elastic piece (202*d*) are installed in the first pressure chamber (201*a*); and the extruded column (202*e*) and the third elastic piece (202*f*) are installed in the second pressure chamber (201*b*). The outer diameter of the pressure plate (202*a*) matches the inner diameter of the first pressure chamber (201*a*), and the pressure plate (202*a*) slides relatively in the first pressure chamber (201*a*). The pressure plate (202*a*) is provided with one or more second unidirectional holes (202*a*-1) whose inner diameters are smaller than the outer diameters of the spheres (202*b*), and the spheres (202*b*) are sealed on the second unidirectional holes (202*a*-1) under the extrusion of the second elastic piece (202*d*). One end of the first elastic piece (202*c*) is extruded on the pressure plate (202*a*), and the other end of the first elastic piece (202*c*) is extruded on the junction between the first pressure chamber (201*a*) and the second pressure chamber (201*b*). One end of the third elastic piece (202*f*) is extruded on the extruded column (202*e*), and the other end of the third elastic piece (202*f*) is extruded on the finite ring (201*e*), and wherein a spherical surface (202*e*-1) is provided at one end of the extruded column (202*e*), and the extruded column (202*e*) is sealed on the first unidirectional holes (201*d*-1) through the spherical surface (202*e*-1) under the extrusion of the third elastic piece (202*f*).

In a third embodiment of the first aspect of the present invention, there is a plurality of the second unidirectional holes (202*a*-1) evenly arranged on the pressure plate (202*a*) along a circumferential direction, and each of the second unidirectional holes (202*a*-1) corresponds to each of the spheres (202*b*), and each of the spheres (202*b*) is fixed on a coupling ring (202*b*-2) through a respective fixed rod (202*b*-1). There is a longitudinally extending guide post (202*a*-2) fixed at the center of the pressure plate (202*a*), and the coupling ring (202*b*-2) is sleeved on the guide post (202*a*-2) and slides relatively. The second elastic piece (202*d*) is sleeved on the periphery of the guide post (202*a*-2), one end of the second elastic piece (202*d*) is extruded on the coupling ring (202*b*-2), and the other end is extruded on an end ring (202*a*-3) located at the end of the guide post (202*a*-2).

In a fourth embodiment of the first aspect of the present invention, the inner wall of the coupling ring (202*b*-2) is provided with limited protrusions, and the outer wall of the guide post (202*a*-2) is provided with limited grooves matching the limited protrusions, and the limited grooves extend along the length of the guide post (202*a*-2), and the limited protrusions are embedded in the limited grooves and slide relatively and longitudinally.

In a fifth embodiment of the first aspect of the present invention, there is a pair of sliders (202*e*-2) extending along their longitudinal direction are symmetrically arranged on the periphery of the extrusion column (202*e*), and one or more slide grooves (201*b*-1) corresponding to the sliders (202*e*-2) are provided on the inner wall of the second pressure chamber (201*b*), and the sliders (202*e*-2) are embedded in the corresponding slide grooves (201*b*-1) and slide relatively and longitudinally.

In a sixth embodiment of the first aspect of the present invention, the push/pull rod (204) protrudes out of the pressure plate (202*a*), the extruded column (202*e*) and the guide post (202*a*-2); and the centers of the pressure plate (202*a*), extruded column (202*e*) and guide post (202*a*-2) are provided with perforations matching the push/pull rod (204).

In a seventh embodiment of the first aspect of the present invention, an extended connection plate (202*a*-4) is further fixed on the pressure plate (202*a*). the drive component (300) includes a bracket (301) fixed on the edge of the first pressure chamber (201*a*); a movable gripper (302) rotatably arranged on the bracket (301) with one end hinged with the connection plate (202*a*-4); and a fixed gripper (303) integrally formed on the bracket (301).

In an eighth embodiment of the first aspect of the present invention, the bracket (301) is provided with a guide sleeve (301*a*) matching the push/pull rod (204), and the push/pull rod (204) passes through the guide sleeve (301*a*) and slides relatively and longitudinally. A handle (204*a*) is provided at the end of the push/pull rod (204).

In a ninth embodiment of the first aspect of the present invention, a laterally extended rotating shaft (202*a*-5) is fixed on the connection plate (202*a*-4), and one end of the movable gripper (302) is provided with an oblong groove (302*a*) corresponding to the rotating shaft (202*a*-5); and the rotating shaft (202*a*-5) is embedded in the oblong groove (302*a*) and relatively rotates and slides in the oblong groove (302*a*).

DETAILED DESCRIPTION

Figure 1:
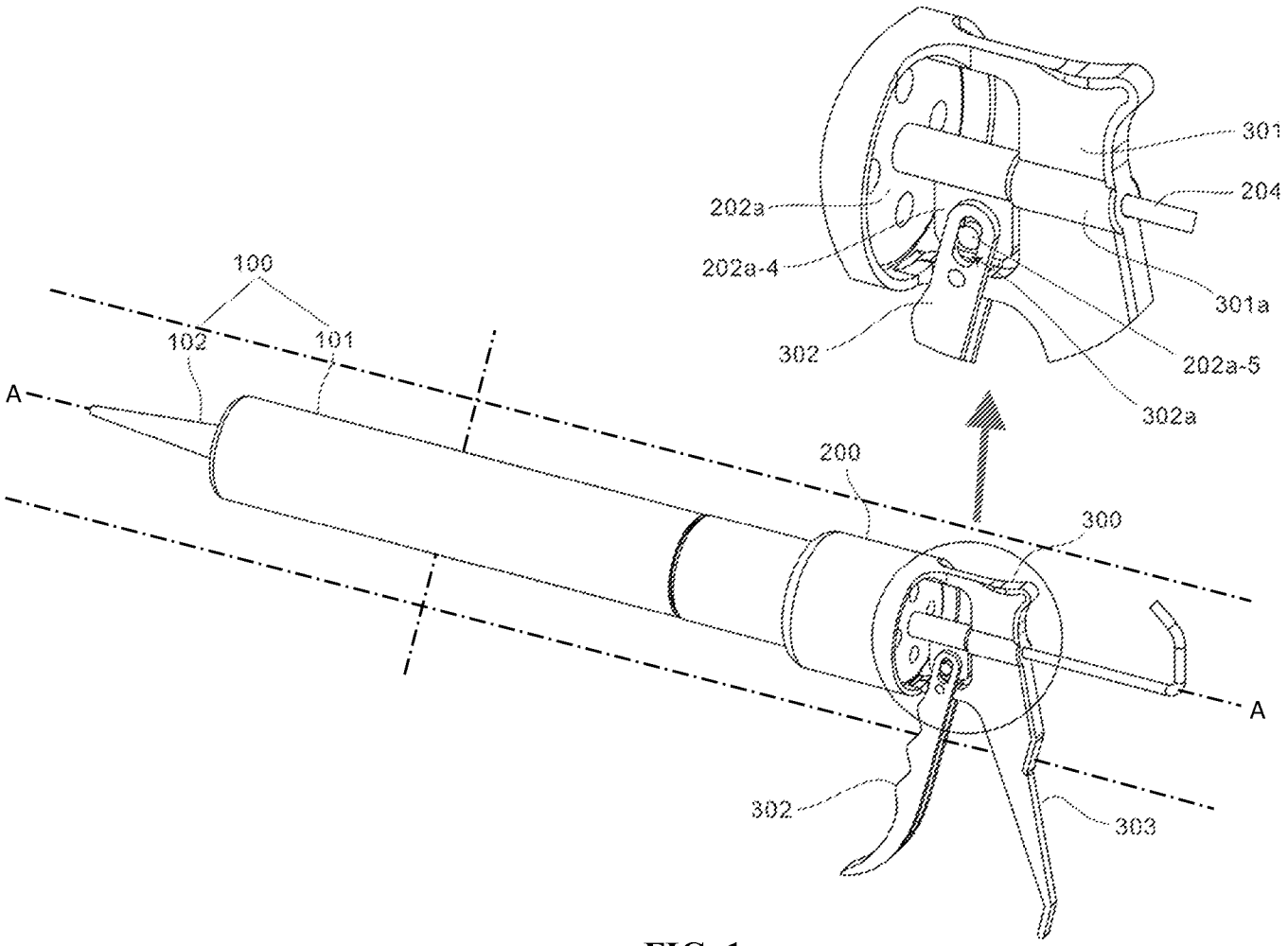
FIG. 1 depicts an overall structure diagram of a pneumatic glue gun and the detailed view of the local structure of a drive component.
Figure 2:
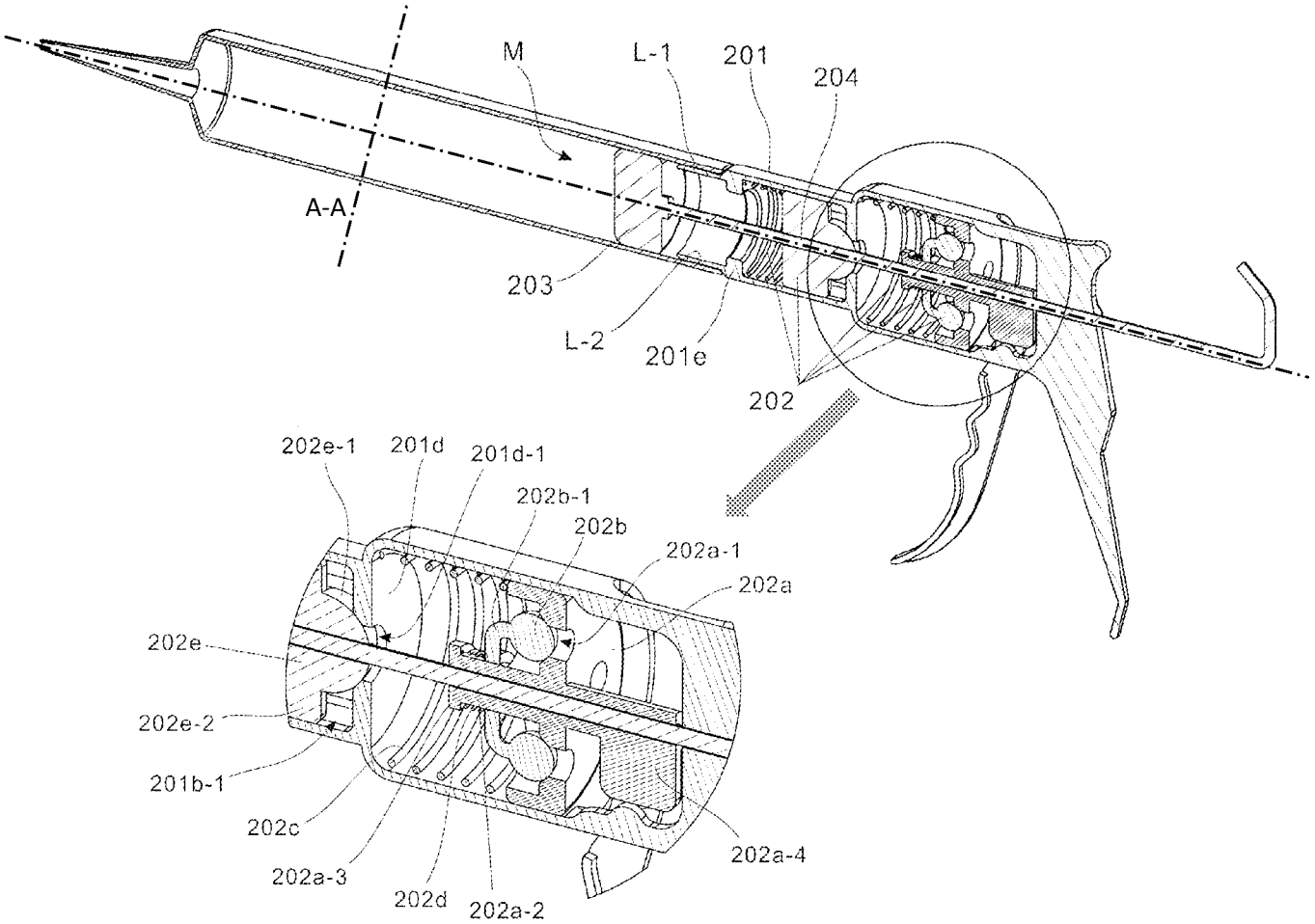
FIG. 2 depicts the internal structure diagram of a pneumatic glue gun and the detailed view of the local structure of pressure generating units.
Figure 3:
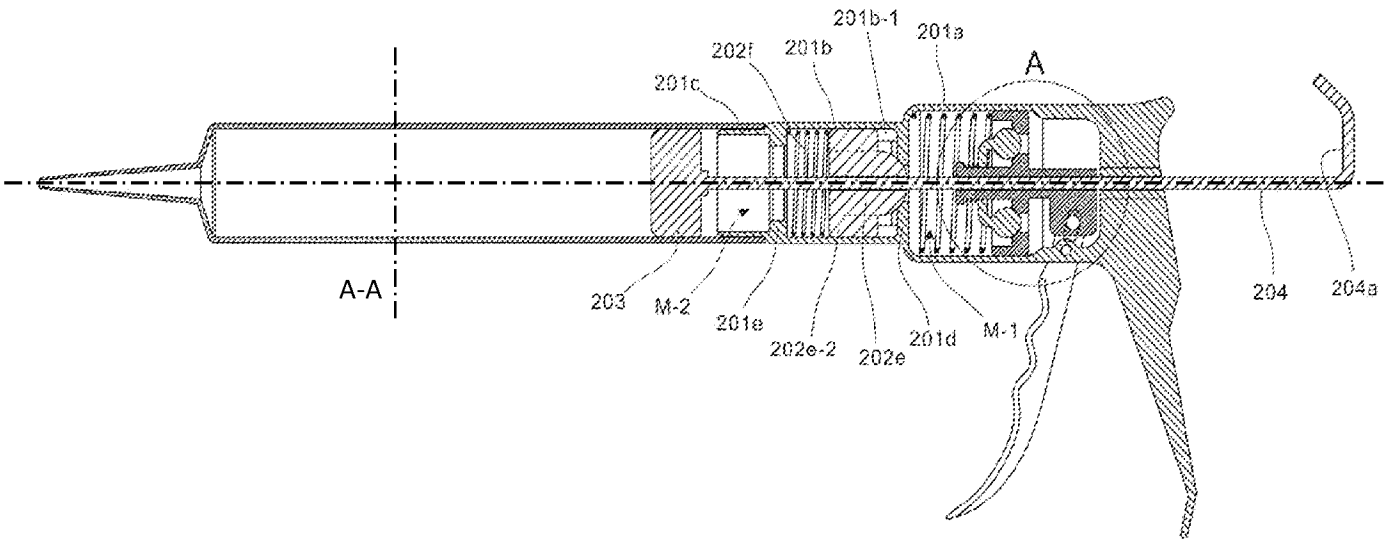
FIG. 3 depicts a sectional drawing of a pneumatic glue gun.
Figure 4:
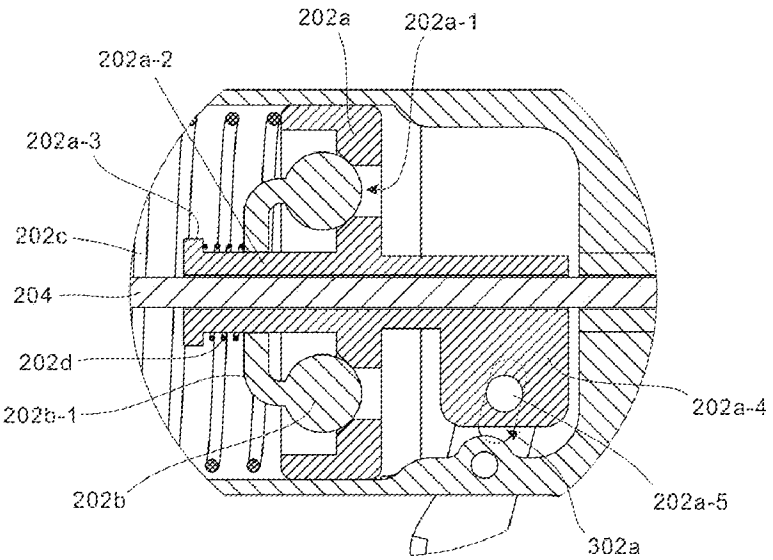
FIG. 4 depicts the detailed view of the structure of Section A in FIG. 3.
Figure 5:
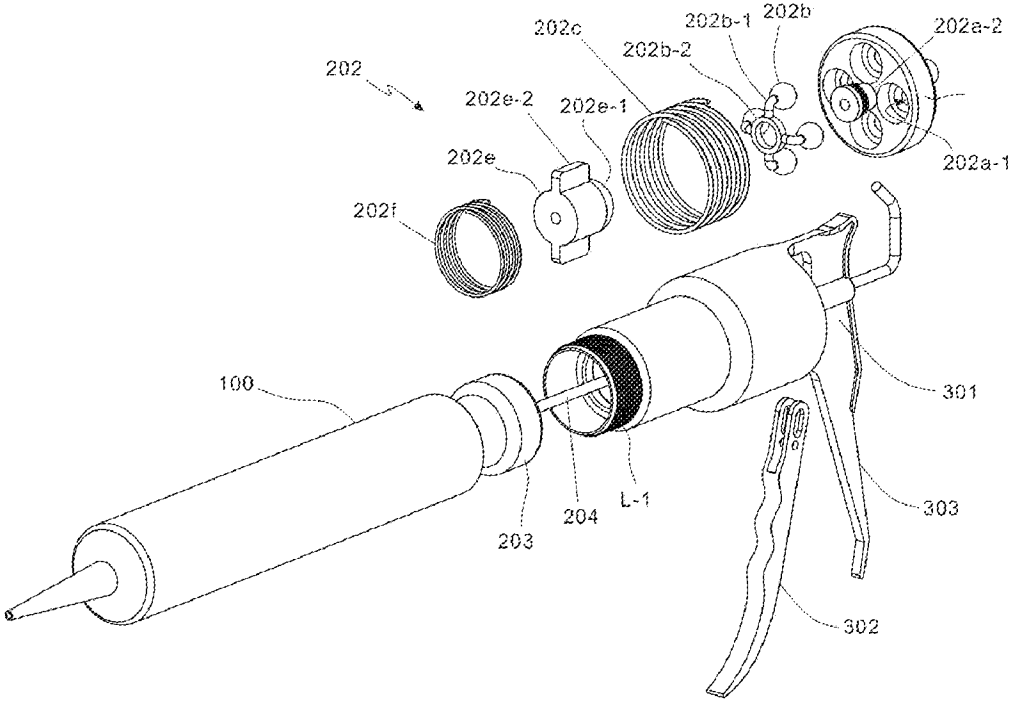
FIG. 5 depicts an exploded view relating to a pneumatic glue gun.

FIGS. 1 to 5 showed an embodiment of the present invention, which provides a pneumatic glue gun including tank components 100, pressure generating units 200 and a drive component 300.

The tank components 100 are used to store and extrude the glue, which include a hollow cylindrical glue tube 101 and an injector head 102 installed at one end of the glue tube 101. The other end of the glue tube 101 is an open end connected with the pressure generating units 200. There is a storage space R inside the glue tube 101 can store the glue. The injector head 102 is a tapered thin tube structure, and the diameter of the end of the injector head 102 is small, which can be used to align the sites where need to be glued and to extrude the glue.

The pressure generating units 200 are used to apply pressure to the storage space R of the glue tube 101 to extrude the glue from the space through the injector head 102. The pressure generating units 200 include a shell 201; an extruder 202 installed inside the shell 201; a slidable piston 203 installed inside the glue tube 101; and a push/pull rod 204 fixed on the piston 203 and protruding out of the shell 201. The tank components 100 are detachably fixed on the shell 201 through an open end of the glue tube 101 and faced the interior space of the shell 201.

The drive component 300 is connected to the extruder 202, which can increase the atmospheric pressure between the extruder 202 and the piston 203 by driving the movement of the extruder 202 in the shell 201, so the piston 203 can slide in the glue tube 101 and extrude the glue accordingly.

Since the tank components 100 and the shell 201 are connected in a detachable manner (e.g. threaded connection), the tank 100 can be disassembled and filled with supplement glue when the glue in the tank 100 is run out, and then installed back onto the shell 201 to achieve the purpose of recycling, therefore its sustainability is good. In addition, since the glue can be replenished at any time without replacing the tank 100, the work of replacing the tank is eliminated, and no waste of resources is caused.

Preferably, the outer end of the injector head 102 can be equipped with a cap, which can be sealed at the end of the injector head 102 to prevent the glue from drying out when the glue gun is not in use.

Furthermore, the shell 201 of the pressure generating units 200 includes a first pressure chamber 201*a*, a second pressure chamber 201*b* and a connection end 201*c*. The three are connected in sequence, and are preferably an integrated sleeve-like structures, where the connection end 201*c* is located at the front-end, and the first pressure chamber 201*a* is located at the rear end. The feature "front" referred to in the present invention corresponds to the direction of the head end of the gun, that is, the direction of the injector head 102; the feature "rear" referred to in the present invention corresponds to the direction of the tail end of the gun, that is, the direction of the drive component 300.

The drive component 300 is fixed to the rear end of the first pressure chamber 201*a*; and the outer wall of the connection end 201*c* is provided with an external thread L-1, the inner wall of the open end of the glue tube 101 is provided with an internal thread L-2 which matches the external thread L-1, and the open end of the glue tube 101 is fixed on the connection end 201*c* through the matching threads.

There is a clapboard 201*d* installed between the first pressure chamber 201*a* and the second pressure chamber 201*b*, the central position of the clapboard 201*d* is provided with one or more first unidirectional holes 201*d*-1, which are round holes, enabling the internal spaces of the first pressure chamber 201*a* and the second pressure chamber 201*b* to be connected with each other. There is a finite ring 201*e* installed between the second pressure chamber 201*b* and the connection end 201*c*, and the inner diameter of the finite ring 201*e* is smaller than that of the second pressure chamber 201*b*.

The extruder 202 of the present invention includes a pressure plate 202*a*, a sphere 202*b*, a first elastic piece 202*c*, and a second elastic piece 202*d*, all of them are installed in the first pressure chamber 201*a*; and further includes an extruded column 202*e* and a third elastic piece 202*f*, both are installed in the second pressure chamber 201*b*.

Among them, the pressure plate 202*a* has a disc structure, whose outer diameter matches the inner diameter of the first pressure chamber 201*a*, and the pressure plate 202*a* can slide relatively in the first pressure chamber 201*a*. The pressure plate 202*a* is provided with one or more second unidirectional holes 202*a*-1, whose inner diameters are smaller than the outer diameters of the spheres 202*b*, and the spheres 202*b* are sealed on the second unidirectional holes 202*a*-1 under the extrusion of the second elastic piece 202*d*; one end of the first elastic piece 202*c* is extruded on the outer edge of the pressure plate 202*a*, and the other end of the first elastic piece 202*c* is extruded on the junction between the first pressure chamber (201*a*) and the second pressure chamber 201*b*.

One end of the third elastic piece 202*f* is extruded on the extruded column 202*e*, and the other end of the third elastic piece 202*f* is extruded on the finite ring 201*e*; the front end of the extruded column 202*e* connects with the third elastic piece 202*f*, and a spherical surface 202*e*-1 is provided at the rear end of the extruded column 202*e*, and the extruded column 202*e* can be sealed on the first unidirectional holes 201*d*-1 through the spherical surface 202*e*-1 under the extrusion of the third elastic piece 202*f* The outer diameter of the extruded column 202*e* is larger than the inner diameter of the first unidirectional holes 201*d*-1, and is smaller than the inner diameter of the second pressure chamber 201*b*.

Preferably, a plurality of the second unidirectional holes 202*a*-1 (4 holes in the present invention) are uniformly distributed on the pressure plate 202*a* along its circumferential direction, each second unidirectional hole 202*a*-1 respectively corresponds to a sphere 202*b*, and each sphere 202*b* is uniformly fixed on a ring-shaped coupling ring 202*b*-2 through respective fixed rods 202*b*-1.

There is a longitudinally extending guide post 202*a*-2 fixed at the center of the pressure plate 202*a*, and the coupling ring 202*b*-2 is sleeved on the guide post 202*a*-2 and can slide relatively; the second elastic piece 202*d* is sleeved on the periphery of the guide post 202*a*-2, where one end is extruded on the coupling ring 202*b*-2, and the other end is extruded on an end ring 202*a*-3 located at the end of the guide post 202*a*-2. Preferably, the first elastic piece 202*c*, the second elastic piece 202*d*, and the third elastic piece 202*f* of the present invention may all adopt compression springs.

In addition, a push/pull rod 204 protrudes out of the pressure plate 202*a*, the extruded column 202*e* and the guide post 202*a*-2, and the centers of the pressure plate 202*a*, extruded column 202*e* and guide post 202*a*-2 are provided with perforations matching the push/pull rod 204.

Furthermore, the inner wall of the coupling ring 202*b*-2 may be provided with limited protrusions, which have block structure protruding outward from the inner wall of the coupling ring 202*b*-2; the outer wall of the guide post 202*a*-2 is provided with limited grooves matching the limited protrusions, the limited grooves have bar-shaped groove structures that extend along the length direction of the guide post 202*a*-2; the limited protrusions are embedded in the limited grooves and slide relatively and longitudinally, so as to ensure that the coupling ring 202*b*-2 can only slide longitudinally related to the guide post 202*a*-2, but cannot rotate circumferentially instead. Therefore, each sphere 202*b* can be accurately pressed and sealed in the corresponding second unidirectional holes 202*a*-1.

Furthermore, a pair of sliders 202*e*-2 extending along their longitudinal direction are symmetrically arranged on the periphery of the extrusion column 202*e*, and the slide grooves 201*b*-1 correspond to the sliders 202*e*-2 are provided on the inner wall of the second pressure chamber 201*b*, and the sliders 202*e*-2 are embedded in a corresponding slide grooves 201*b*-1 and slide relatively and longitudinally.

Furthermore, an extended connection plate 202*a*-4 is further fixed on the pressure plate 202*a*, which has a plate-like structure, and is integrally formed at the rear end of the pressure plate 202*a*.

In addition, the drive component 300 of the present invention includes a bracket 301 fixed on the edge of the first pressure chamber 201*a*; a movable gripper 302 rotatably arranged on the bracket 301 whose one end hinged with the connection plate 202*a*-4; and a fixed gripper 303 integrally formed on the bracket 301.

The bracket 301 is provided with a guide sleeve 301*a* which matches the push/pull rod 204, the guide sleeve 301*a* is a hollow sleeve structure integrally formed on the bracket 301, and the push/pull rod 204 passes through the guide sleeve 301*a* and can slide relatively and longitudinally. There is a handle 204*a* at the end of the push/pull rod 204, which can directly and manually pull out the push/pull rod 204 and the piston 203 at the front end of the rod.

Preferably, a laterally extended rotating shaft 202*a*-5 is fixed on the connection plate 202*a*-4, and one end of the movable gripper 302 is provided with an oblong groove 302*a* which corresponds to the rotating shaft 202*a*-5; the rotating shaft 202*a*-5 is embedded in the oblong groove 302*a* and relatively rotates and slides in the oblong groove 302*a*. Therefore, by holding the fixed gripper 303 and the movable gripper 302 in hand, and rotating the movable gripper 302 close to the fixed gripper 303, the connection plate 202*a*-4 (the entire pressure plate 202*a*) can be driven to slide forward in a manner of a lever.

Definition: the space between the pressure plate 202*a* and the clapboard 201*d* is defined as the first pressure space M-1; the space between the extruded column 202*e* and the piston 203 is defined as the second pressure space M-2.

Based on the above, the specific glue dispensing process of the pneumatic glue gun of the present invention includes: when holding the fixed gripper 303 and the movable gripper 302 and pressing the movable gripper 302, the upper end of the movable gripper 302 can drive the pressure plate 202*a* to slide forward in the first pressure chamber 201*a*. Sliding forward the pressure plate 202*a* causes the space in the first pressure space M-1 be compressed, and the air pressure gradually increases. As the spheres 202*b* are sealed at the front end of the second unidirectional holes 202*a*-1, when the air pressure in the first pressure space M-1 increases, each of the spheres 202*b* can be more strictly sealed on each of the second unidirectional holes 202*a*-1. When the air pressure in the first pressure space M-1 increases to a certain degree, the gas in the first pressure space M-1 can push away the extruded column 202*e* sealed on the first unidirectional holes 201*d*-1, and pass through the first unidirectional holes 201*d*-1 and the interlayer space between the extruded column 202*e* and the inner wall of the second pressure chamber 201*b*, and then it finally enters the second pressure space M-2. Subsequently, the third elastic piece 202*f* can re-extrude the extruded column 202*e* which has detached from the first unidirectional holes 201*d*-1 onto the first unidirectional holes 201*d*-1. As the amount of the gas in the second pressure space M-2 gradually increases, the air pressure also gradually increases until the piston 203 can be pushed forward to extrude the glue in the glue tube 101. When the movable gripper 302 is released, the pressure plate 202*a* can be moved back to be reset through the extrusion of the first elastic piece 202*c*, while the space in the first pressure space M-1 is elongated, and the air pressure gradually decreases. In contrast, the extruded column 202*e* can be more strictly extruded and sealed on the first unidirectional holes 201*d*-1, while the outside air can disperse each of the spheres 202*b*, making it slide forward along the guide post 202*a*-2 and disengage from the second unidirectional holes 202*a*-1 to make up for the lack of air pressure in the first pressure space M-1 and achieve air pressure balance. When the air which is replenished from the outside to the first pressure space M-1 reaches the internal or external pressure balance or almost balance, each of the spheres 202*b* can be sealed on each of the corresponding second unidirectional holes 202*a*-1 again under the extrusion of the second elastic piece 202*d*. In this way, the process of pressing the movable gripper 302 and compressing the first pressure space M-1 in the next round can be prepared. By circulating in this way, the outside air can be continuously transferred from the first pressure space M-1 to the second pressure space M-2, so as to realize the continuous squeezing and pushing process of the piston 203.

Since the above process is performed continuously, the piston 203 can be driven to slide forward gradually by reciprocatingly pressing the movable gripper 302 to realize the process of squeezing out the glue.

Though reference is made to preferred examples for detailed illustration of the present invention and non-limiting thereto, a skilled person in the art should understand that the technical solutions provided by the present invention can be changed or replaced by equivalents without departing from the spirit and scope of the technical solutions described herein, which should fall within the scope of the appended claims.

The invention claimed is:

1. A pneumatic glue gun, comprising:

tank components, the tank components comprising a glue tube and an injector head installed at a first end of the glue tube, wherein a storage space is inside the glue tube;

pressure generating units, the pressure generating units comprising a shell, an extruder installed inside the shell, a slidable piston installed inside the glue tube, and a push/pull rod fixed on the piston and protruding out of the shell, wherein the tank components are fixed on the shell through an open end of the glue tube and face an interior space of the shell; and a drive component connected with the extruder, wherein the drive component increases the atmospheric pressure between the extruder and the piston by driving a movement of the extruder in the shell, and wherein the piston slides in the glue tube as a result of the increased atmospheric pressure, wherein an extended connection plate is further fixed on a pressure plate, wherein the drive component comprises:

a bracket fixed on the edge of the first pressure chamber;

a movable gripper rotatably arranged on the bracket with one end hinged with the connection plate; and a fixed gripper integrally formed on the bracket.

2. The pneumatic glue gun of claim 1, wherein the shell comprises a first pressure chamber;

a second pressure chamber; and a connection end, wherein the first and second pressure chambers and the connection end are connected in sequence, wherein the drive component is fixed on the first pressure chamber, wherein an outer wall of the connection end is provided with an external thread; an inner wall of the open end of the glue tube is provided with an internal thread matching the external thread; and the open end of the glue tube is fixed on the connection end through the matching threads.

3. The pneumatic glue gun of claim 2, wherein a clapboard is installed between the first pressure chamber and the second pressure chamber, and the clapboard is provided with one or more first unidirectional holes, and wherein a finite ring is installed between the second pressure chamber and the connection end, and an inner diameter of the finite ring is smaller than an inner diameter of the second pressure chamber, and wherein the extruder comprises a pressure plate;

one or more spheres;

a first elastic piece;

a second elastic piece;

an extruded column; and a third elastic piece, wherein the pressure plate, the spheres, the first elastic piece and the second elastic piece are installed in the first pressure chamber; the extruded column and the third elastic piece are installed in the second pressure chamber, and wherein the outer diameter of the pressure plate matches the inner diameter of the first pressure chamber, and the pressure plate slides relatively in the first pressure chamber, and wherein the pressure plate is provided with one or more second unidirectional holes, wherein inner diameters thereof are smaller than the outer diameters of the spheres, and the spheres are sealed on the second unidirectional holes under the extrusion of the second elastic piece, and wherein one end of the first elastic piece is extruded on the pressure plate, and the other end of the first elastic piece is extruded on the junction between the first pressure chamber and the second pressure chamber, and wherein one end of the third elastic piece is extruded on the extruded column, and the other end of the third elastic piece is extruded on the finite ring, and wherein a spherical surface is provided at one end of the extruded column, and the extruded column is sealed on the first unidirectional holes through the spherical surface under the extrusion of the third elastic piece.

4. The pneumatic glue gun of claim 3, wherein a plurality of the second unidirectional holes are evenly arranged on the pressure plate along a circumferential direction, and each of the second unidirectional holes corresponds to each of the spheres, and each of the spheres is fixed on a coupling ring through each of respective fixed rods, and wherein a longitudinally extending guide post is fixed at a center of the pressure plate, and the coupling ring is sleeved on the guide post and slides relatively, and wherein the second elastic piece is sleeved on the periphery of the guide post, one end of the second elastic piece is extruded on the coupling ring, and the other end is extruded on an end ring located at the end of the guide post.

5. The pneumatic glue gun of claim 4, wherein the inner wall of the coupling ring is provided with limited protrusions, and the outer wall of the guide post is provided with limited grooves matching the limited protrusions, and the limited grooves extend along the length of the guide post, and wherein the limited protrusions are embedded in the limited grooves and slide relatively and longitudinally.

6. The pneumatic glue gun of claim 5, wherein a pair of sliders extending along the longitudinal direction of the extruded column are symmetrically arranged, and one or more slide grooves corresponding to the sliders are provided on the inner wall of the second pressure chamber, and the sliders are embedded in the corresponding slide grooves and slide relatively and longitudinally.

7. The pneumatic glue gun of claim 4, wherein a pair of sliders extending along their longitudinal direction are symmetrically arranged on the periphery of the extrusion column, and one or more slide grooves corresponding to the sliders are provided on the inner wall of the second pressure chamber, and the sliders are embedded in the corresponding slide grooves and slide relatively and longitudinally.

8. The pneumatic glue gun of claim 3, wherein a pair of sliders extending along their longitudinal direction are symmetrically arranged on the periphery of the extrusion column, and one or more slide grooves corresponding to the sliders are provided on the inner wall of the second pressure chamber, and the sliders are embedded in the corresponding slide grooves and slide relatively and longitudinally.

9. The pneumatic glue gun of claim 2, wherein the push/pull rod protrudes out of a pressure plate, an extruded column and a guide post; and centers of the pressure plate, extruded column and guide post are provided with perforations matching the push/pull rod.

10. The pneumatic glue gun of claim 1, wherein the bracket is provided with a guide sleeve matching the push/pull rod, and the push/pull rod passes through the guide sleeve and slides relatively and longitudinally, and wherein a handle is provided at the end of the push/pull rod.

11. The pneumatic glue gun of claim 10, wherein a laterally extended rotating shaft is fixed on the connection plate, and one end of the movable gripper is provided with an oblong groove corresponding to the rotating shaft; and the rotating shaft is embedded in the oblong groove and relatively rotates and slides in the oblong groove.

* * * * *